US006131899A

United States Patent [19]

Nojima et al.

[11] Patent Number: 6,131,899

[45] Date of Patent: Oct. 17, 2000

[54] SHEET SUPPLYING APPARATUS

[75] Inventors: Takashi Nojima, Mitaka; Atsushi Noda, Kawasaki; Hiroyuki Inoue, Yokohama; Hitoshi Nakamura, Sanjo; Akira Kida, Yokohama; Hideaki Kawakami, Yokohama; Takeshi Iwasaki, Yokohama; Noriko Kawasaki, Tokyo; Takehiko Kiyohara, Zama, all of Japan

[73] Assignee: Canon Kabushiki Kaisha, Tokyo, Japan

[21] Appl. No.: 08/833,127

[22] Filed: Apr. 4, 1997

[30] Foreign Application Priority Data

Apr. 10, 1996 [JP] Japan ..... 8-088109

[51] Int. Cl.[7] ..... B65H 3/52; B65H 1/08; B65H 1/00; B65H 9/04

[52] U.S. Cl. ..... 271/121; 271/127; 271/162; 271/253

[58] Field of Search ..... 271/121, 162, 271/253, 127

[56] References Cited

U.S. PATENT DOCUMENTS

| | | | |
|---|---|---|---|
| 3,417,988 | 12/1968 | Springer . | |
| 4,843,436 | 6/1989 | Evangelista et al. . | |
| 5,026,042 | 6/1991 | Miller | 271/127 |
| 5,052,676 | 10/1991 | Shiina et al. | 271/121 |
| 5,114,133 | 5/1992 | Osada et al. | 271/22 |
| 5,348,283 | 9/1994 | Yanagi et al. . | |
| 5,358,230 | 10/1994 | Ikemori et al. . | |
| 5,370,380 | 12/1994 | Suzuki et al. . | |
| 5,485,991 | 1/1996 | Hirano et al. . | |
| 5,573,235 | 11/1996 | Asai | 271/127 |
| 5,580,042 | 12/1996 | Taniguro et al. . | |
| 5,615,874 | 4/1997 | Parthasarathy et al. | 271/127 |
| 5,620,174 | 4/1997 | Taniguro et al. . | |
| 5,653,433 | 8/1997 | Ishizuka | 271/121 |
| 5,918,873 | 7/1999 | Saito et al. | 271/127 |

FOREIGN PATENT DOCUMENTS

| | | |
|---|---|---|
| 0 281 073 | 9/1988 | European Pat. Off. . |
| 5-092641 | 4/1993 | Japan . |
| 6-247580 | 9/1994 | Japan . |
| 8-040590 | 2/1996 | Japan . |
| 8-40590 | 2/1996 | Japan . |

*Primary Examiner*—Christopher P. Ellis
*Assistant Examiner*—Brett C. Martin
*Attorney, Agent, or Firm*—Fitzpatrick, Cella, Harper & Scinto

[57] ABSTRACT

A sheet supplying apparatus includes a sheet supporter for supporting sheets, a supply rotary device for feeding out the sheets supported by the sheet supporter, a separation member for separating sheets fed by the supply rotary device one by one by elastically changing an inclination angle of the separation member when the sheets fed by the supply rotary means abut against and ride over the separation member, and a sheet guide member removably disposed above the sheet supporting means and adapted to guide the sheet in such a manner that the sheet is subjected to resistance of the separation member smaller than resistance from the separation member to the sheet when the sheets are supplied from the sheet supporter.

12 Claims, 7 Drawing Sheets

SHEET SUPPLYING APPARATUS

BACKGROUND OF THE INVENTION

1. Field of the Invention

The present invention relates to a sheet supplying apparatus for separating and supplying sheets resting on a sheet stacking member, one by one, by using a supply rotary member, and more particularly, it relates to a sheet guide member capable of positively separating and supplying thin sheets or thick sheets one by one, a sheet supplying apparatus on which such a sheet guide can be mounted, and an image forming apparatus on which such a sheet guide member can be mounted.

2. Related Background Art

In many image forming apparatuses, such as copying machines, facsimiles and printers, which have now been used, a plurality of recording sheets are stacked on a sheet stacking member and the sheets are separated and supplied, one by one, to form an image on the sheet. In such apparatuses, in order to separate and supply the stacked sheets one by one, there have been proposed a so-called pawl separation mechanism in which a pawl is provided at an end of a sheet cassette and the sheets are separated, one by one, by contacting corners of the sheets supplied by a supply roller and a so-called retard separation mechanism, in which the sheets are separated, one by one, by a supply roller rotated in a sheet supplying direction and a retard roller rotated in a sheet returning direction, by utilizing friction between the sheets.

However, in the above-mentioned pawl separation mechanism, the position of the pawl must be changed in accordance with a sheet-width size. On the other hand, the above-mentioned retard separation mechanism makes the apparatus bulky and complicated.

To solve the above problems, another separation means has been proposed, as disclosed in the Japanese Patent Application Laid-Open No. 8-40590. In this separation means, a thin plate made of Myler and the like is used to cause sheets supplied by a supply roller to thereby urge thereagainst, so that the sheets are separated, one by one, by flexing or deflecting the thin plate. This separation means can separate relatively thick sheets and relatively thin sheets.

However, very thick sheets and very thin sheets cannot be separated effectively with such separation means.

SUMMARY OF THE INVENTION

The present invention intends eliminate the above-mentioned conventional drawbacks, and has an object to positively separate very thick sheets or very thin sheets by a separation means having a simple construction.

To achieve the above object, a sheet supplying apparatus according to the present invention comprises a sheet supporting means for supporting sheets, a supply rotary means for feeding out the sheets supported by the sheet supporting means, a separation member for separating the sheets fed by the supply rotary means one by one, and a sheet guide member removably disposed above the sheet supporting means and adapted to guide the sheet beyond a separation means.

The separation means may be designed so that, when the sheets fed by the supply rotary means abut against and ride over the separation means, the separation means is elastically deformed to separate the sheets one by one, and the sheet guide member may be designed so that the sheets supplied from the sheet supporting means are subjected to a resistance force (from the separation means) smaller than a resistance force given from the separation member.

Further, the sheet guide member may be pivotally mounted on the sheet supporting means and may have a protruded portion protruding toward the sheet to guide the sheet in a downstream direction, and the sheet guide member may be designed so that the sheet guide member is rocked when the protruded portion is pushed by the rigidity of the sheet by an angle corresponding to the sheet rigidity. In addition, the sheet guide member may be provided with a cleaning means for cleaning the supply rotary means.

DETAILED DESCRIPTION OF THE PREFERRED EMBODIMENTS

Now, an image forming apparatus using a sheet guide member and a sheet supplying apparatus according to the present invention will be explained with reference to FIGS. 1A, 1B, 1C, 2, 3, 4, 5A, 5B, 5C, 6 and 7.

First of all, the entire construction of the image forming apparatus including the sheet supplying apparatus will be described, and then, a sheet supplying operation of the sheet supplying apparatus with a sheet guide member mounted thereon will be described.

(Entire Construction of Image Forming Apparatus)

Figure 3:
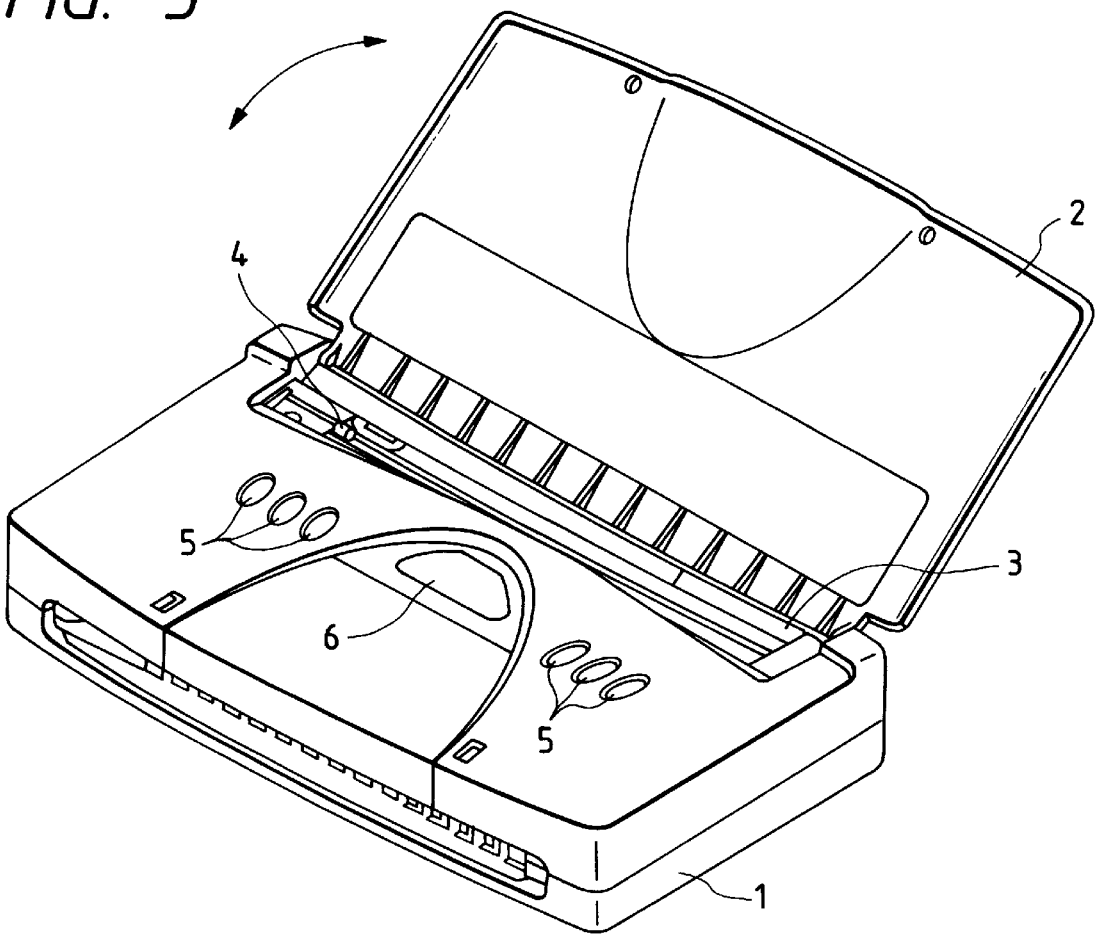
FIG. 3 is a perspective view of an image forming apparatus.
Figure 4:
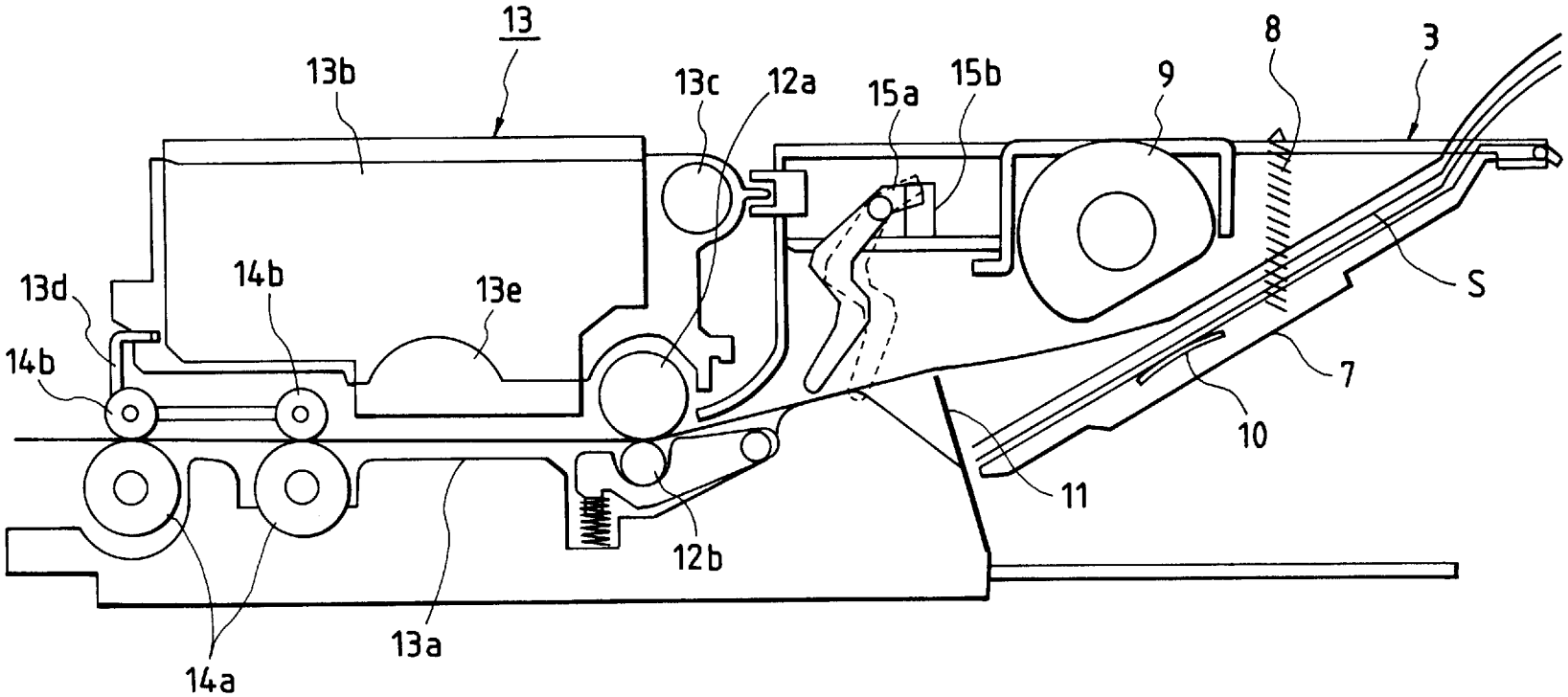
FIG. 4 is a schematic sectional view of the image forming apparatus.

As shown in FIGS. 3 and 4, the image forming apparatus is embodied as a portable compact ink jet printer. When an upper cover 2 is opened with respect to a main body of the printer (printer body) 1, a sheet supply opening 3 is exposed and the upper cover 2 also acts as a sheet supply tray. At one end of the sheet supply opening 3, there is provided a side guide 4 slidable in a sheet width-wise direction (perpendicular to a sheet conveying direction) so that lateral edges of sheets are aligned with each other by sliding the side guide in accordance with the sheet size.

Incidentally, in FIG. 3, the reference numeral 5 denotes top keys, such as a record start key; and 6 denotes a display portion on which an operation condition, a setting condition, an error mode, or the like, can be displayed.

When the sheets S are inserted through the supply opening 3, as shown in FIG. 4, the sheet S are stacked on a pressure plate (sheet stacking member) 7 as a sheet stack. The pressure plate 7 is biased upwardly (FIG. 4) by means of pressure plate springs 8, and a pick-up roller (supply rotary member) 9 having a D-shaped cross-section to supply the sheets S is disposed above it. The pressure plate 7 is normally spaced apart from the pick-up roller 9 by a cam (not shown). When a sheet supplying operation is started, the cam is driven to permit the shifting of the pressure plate 7 toward the pick-up roller 9 by the action of the pressure plate springs 8, with the result that an uppermost sheet S in the sheet stack resting on the pressure plate 7 is urged against the pick-up roller 9. In this condition, when the roller 9 is rotated, the sheets are supplied.

Incidentally, separation pads 10 are attached to a surface portion of the pressure plate 7 opposing the pick-up roller 9. A relation of the coefficient of friction between the separation pads 10 and the recording sheet S is selected so that the coefficient of friction between the recording sheets S becomes smaller than the coefficient of friction between the separation pads 10 and the recording sheet S, and the coefficient of friction between the pick-up roller 9 and the recording sheet S becomes greater than the coefficient of friction between the separation pads 10 and the recording sheet S.

There is provided an abutment member (separation means) 11 disposed at a downstream side of the sheet S supplied by the pick-up roller 9 in the sheet supplying direction. The abutment member 11 is formed from an elastically deformable sheet member so that, when tip ends of the supplied sheets S abut there against, the abutment member is elastically deflected to separate the uppermost sheet S from the other sheets.

Figure 5A:
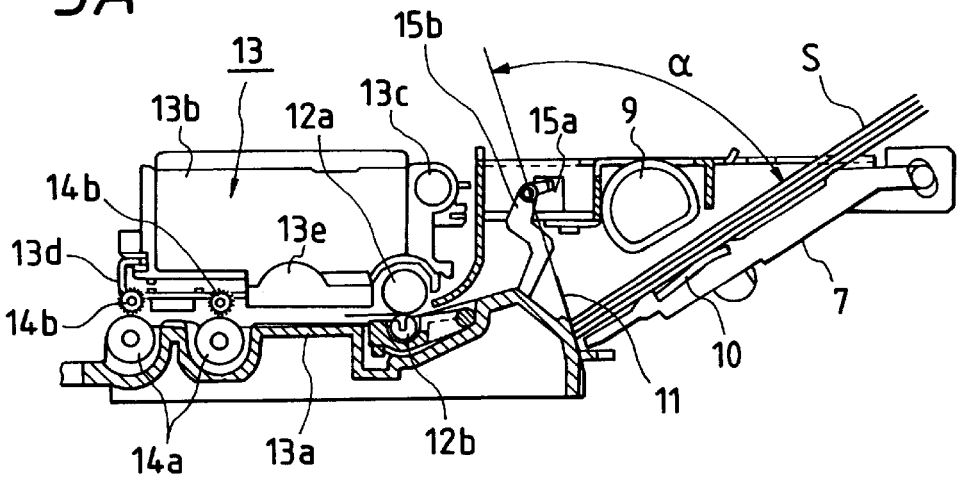
FIGS. 5A, 5B and 5C are views for explaining a sheet separating action of an abutment member.

More concretely, as shown in FIG. 5A, under the condition that the recording sheet stack S is set on the pressure plate 7, the angle $\alpha$ between the sheet stack S and the abutment member 11 is an acute angle smaller than 90°, and the tip end of the recording sheet stack S abut against the abutment member 11 to be stopped there.

Figure 5B:
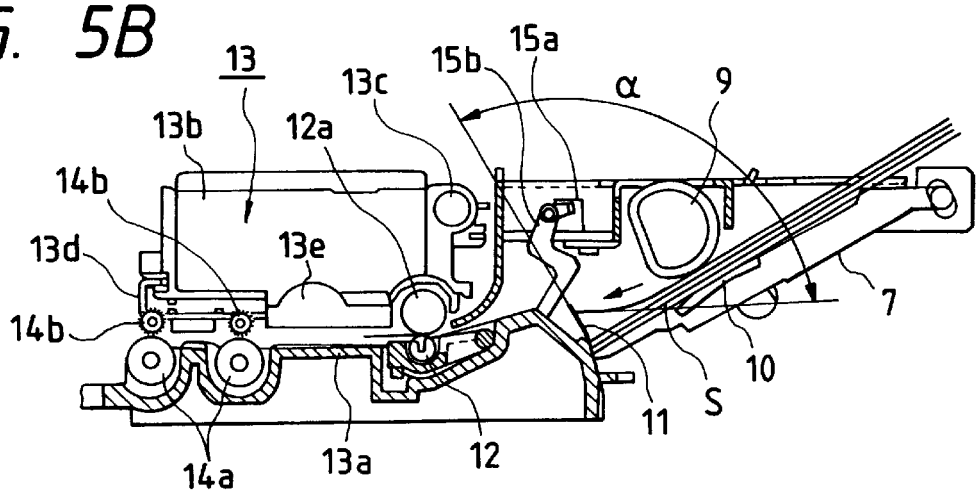

Then, when the pick-up roller 9 is rotated, as shown in FIG. 5B, several upper sheets are pushed forwardly, with the result that the abutment member 11 is deflected by the thrust force of the pushed sheets, thereby gradually increasing the angle $\alpha$. As the abutment member 11 is deflected, since the recording sheets S are also flexed upwardly, the uppermost sheet S is positioned above the other recording sheets, with the result that the angle $\alpha$ between the uppermost sheet S and the abutment member 11 is increased.

Figure 5C:
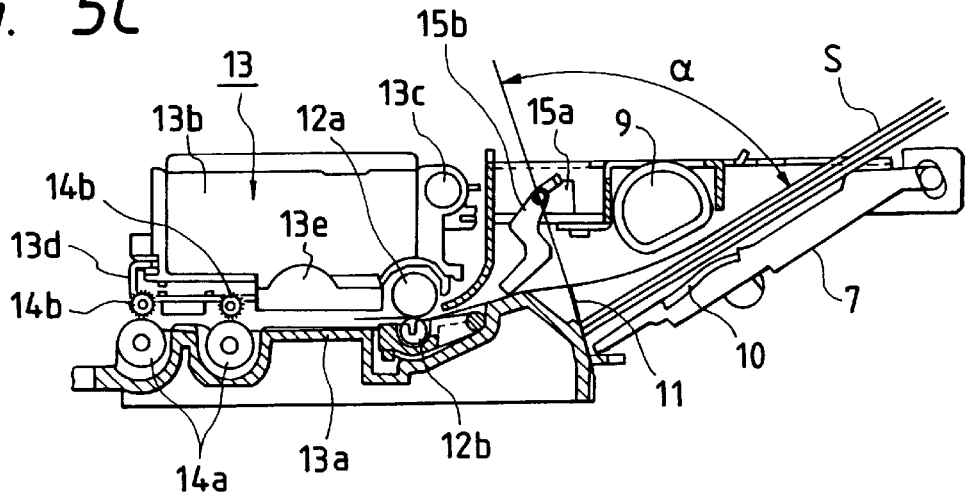

Thereafter, when an angle $\alpha$, in which the thrust force of the pushed sheets exceeds the frictional resistance between the abutment member and the recording sheet, is reached, as shown in FIG. 5C, only the uppermost sheet S is separated and rides over the abutment member 11. When the thrust force from the pick-up roller 9 ceases, the abutment member 11 is elastically returned to its original position. In this way, the recording sheets S stacked on the pressure plate 7 are separated and supplied, one by one.

Then, the separated recording sheet S is conveyed to a recording means 13 by a drive rotary convey roller 12*a* disposed at a downstream side of the abutment member 11 in the sheet supplying direction and a pinch roller 12*b* for urging the recording sheet S against the convey roller.

In the illustrated embodiment, the recording means 13 is of the ink jet recording type, and as shown in FIG. 4, there are provided a platen 13*a* for supporting a back surface of the recording sheet S to be conveyed and a carriage 13*b* opposed to the platen. The carriage 13*b* can be reciprocally shifted by a motor (not shown) along a guide shaft 13*c* extending to the sheet widthwise direction and a guide rail 13*d*, and an ink jet recording head 13*e* is mounted on the carriage 13*b*. While the carriage 13*b* is being shifted, by discharging ink from the recording head 13*e*, a desired image is recorded on the recording sheet S.

The recording head 13*e* includes fine or small liquid discharge openings (orifices), liquid passages communicating with the respective discharge openings, energy acting portions disposed in the respective liquid passages, and energy generating means for generating liquid-droplet forming energy in the liquid at the acting portions. The energy-generating means may be used as a recording method utilizing electrical/mechanical converters, such as piezo-electrical elements, a recording method utilizing energy-generating means for generating heat by electromagnetic-wave illumination by means such as a laser and for discharging liquid droplets by the action of the heat, or a recording method utilizing energy-generating means for discharging liquid by heating the liquid by means of electrical/thermal converters, such as heating elements having a heating-resistance body.

Among these recording methods, in recording heads used in an ink-jet recording method for discharging ink by thermal energy, since liquid discharge openings (orifices) for discharging recording ink droplets can be arranged with high density, a recording having a high resolving power can be expected. Among these recording head, recording heads having electrical/thermal converters used as the energy generating means can easily be made compact, can be mounted with high density, and can be made cheaper.

Incidentally, in the illustrated embodiment, the recording head is designed so that the electrical/thermal converter is energized in response to a recording signal and the ink is discharged from the discharge opening by growth and contraction of a bubble generated in the ink by film-boiling caused by the thermal energy from the converter.

The recording sheet S on which the image was formed by the recording head 13 is discharged out of the printer by drive discharge rollers 14*a* and spur wheels 14*b* urging the sheet against the discharge rollers and rotatingly driven by rotation of the discharge rollers. Incidentally, the term "spur wheel" used herein refers to a rotary member having a small contact area (to the recording sheet S) so that, even when it contacts the imaged surface of the recording sheet, the ink image is not distorted. Incidentally, in FIG. 4, the reference numeral 15*a* denotes a sensor lever for detecting the presence/absence of the sheet; and 15*b* denotes a sensor for detecting an operation of the lever 15*a* .

Although the sheets S can be separated by a simple construction only including the abutment member 11 formed from the elastic member, in this separation mechanism, since the abutment member 11 is deflected by urging the sheets S against the abutment member 11, if very thin sheets (for example, report paper sheets having a weight smaller than 45 g/m$^2$) are used, there is a danger that the sheets cannot deflect the abutment member 11 and are buckled.

Figure 6:
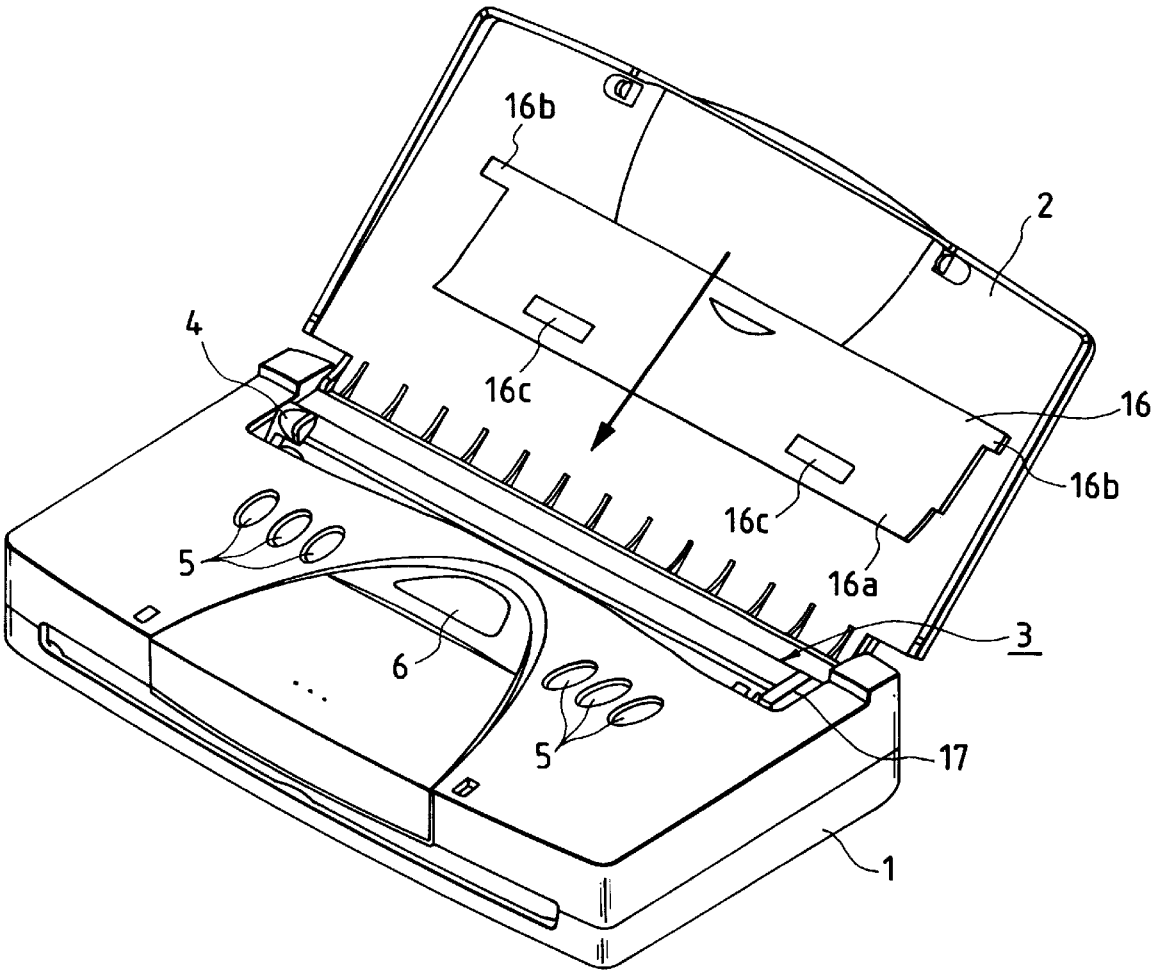
FIG. 6 is a perspective view showing a method for mounting a sheet guide member at a sheet supply opening of the apparatus.

To avoid such a danger, in the illustrated embodiment, a sheet guide member 16 as shown in FIG. 6 can be mounted on the pressure plate 7. Thus, when the thin sheets are supplied, by mounting the sheet guide member 16, separation resistance of the sheet can be reduced.

(Sheet Guide Member)

Figure 7:
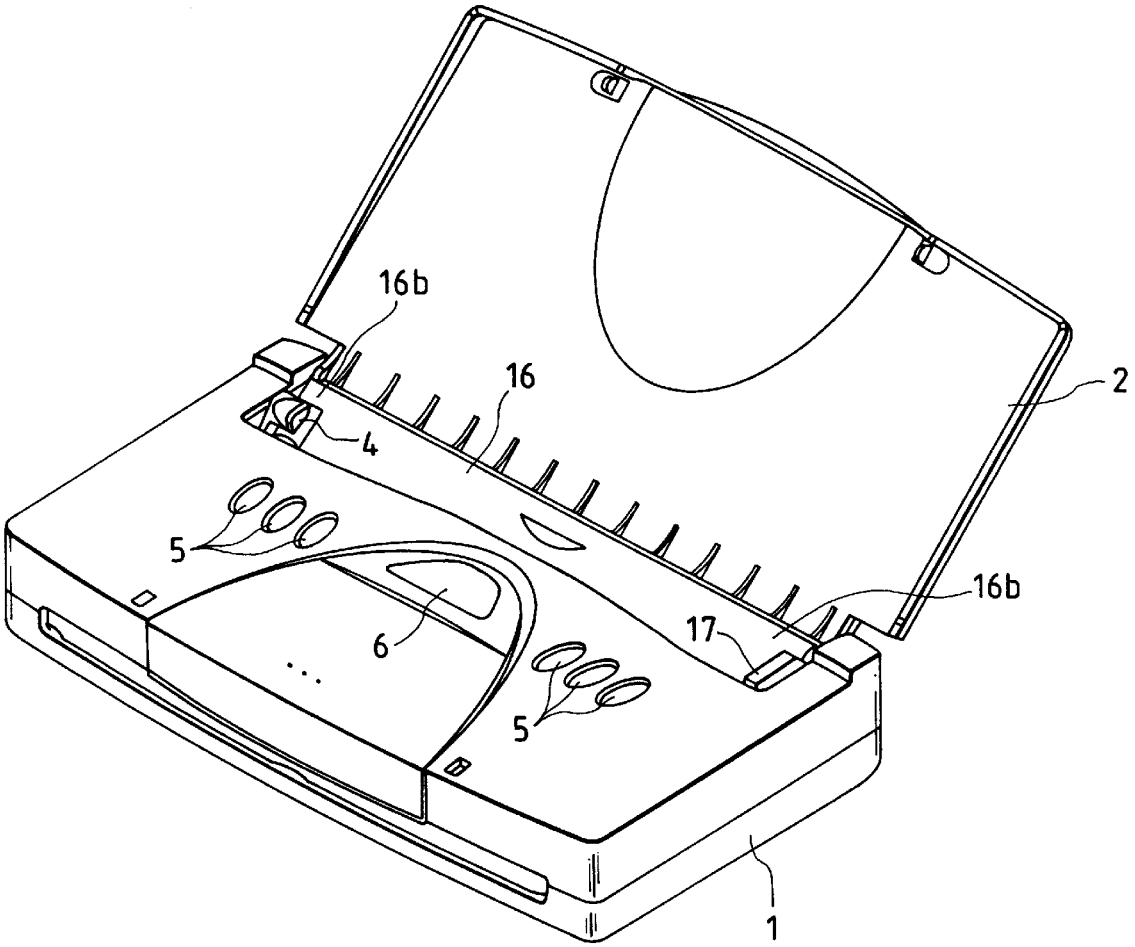
FIG. 7 is a perspective view showing a condition that the sheet guide member is mounted at the sheet supply opening of the apparatus.

Now, the sheet guide member 16 will be described. As shown in FIGS. 6 and 7, the sheet guide member 16 can be inserted into the printer through the sheet supply opening 3 and has a guide portion 16*a* having a free end portion curved upwardly toward the sheet supplying direction and locking portions 16*b*. Further, the free end of the sheet guide member includes a protruded portion 16*d*.

When the guide portion 16*a* of the guide member is inserted through the supplying opening 3, the locking portions 16*b* of the guide member are engaged by slidable side guide 4 and a fixed side guide 17 positioned at at reference side, so that the sheet guide member is prevented from shifting toward an inserting direction, i.e., toward a downward direction along the surface of the pressure plate 7. In this case, as will be described later, the sheet guide member 16 is designed so that, even when the guide member is rocked around a pivot center J (FIG. 2), the locking portions 16*b* are not disengaged from the side guides, thereby preventing the sheet guide member from dropping downwardly.

Figure 1A:
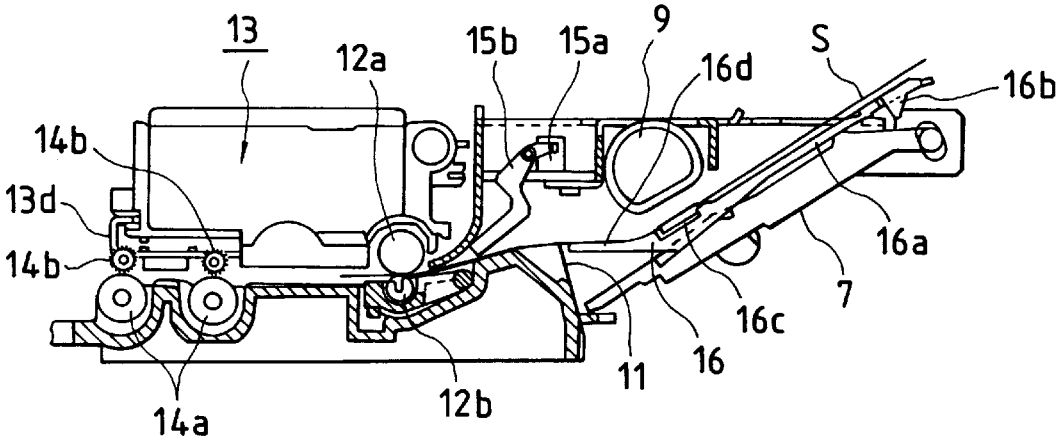
FIGS. 1A, 1B and 1C are views for explaining a condition that thin sheets are supplied by a sheet supplying apparatus with a sheet guide member mounted thereon.

Under the condition that the sheet guide member 16 is attached, when the thin sheets S are inserted through the supply opening 3, the sheets S are set on the guide member 16 as a sheet stack. In this case, as shown in FIG. 1A, since the free end (tip end) portion of the guide portion 16*a* is curved so that the tip end is positioned slightly above in the vicinity of the upper end of the abutment member 11, when the recording sheet stack S is set on the guide member, the tip end of the sheet stack S is positioned slightly above the upper end of the abutment member 11 or abuts against the upper end of the abutment member 11.

Figure 1B:
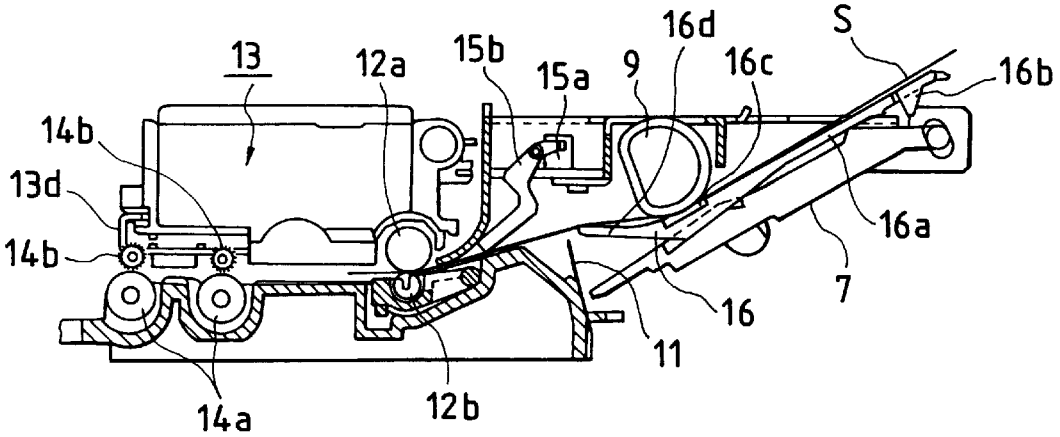
Figure 1C:
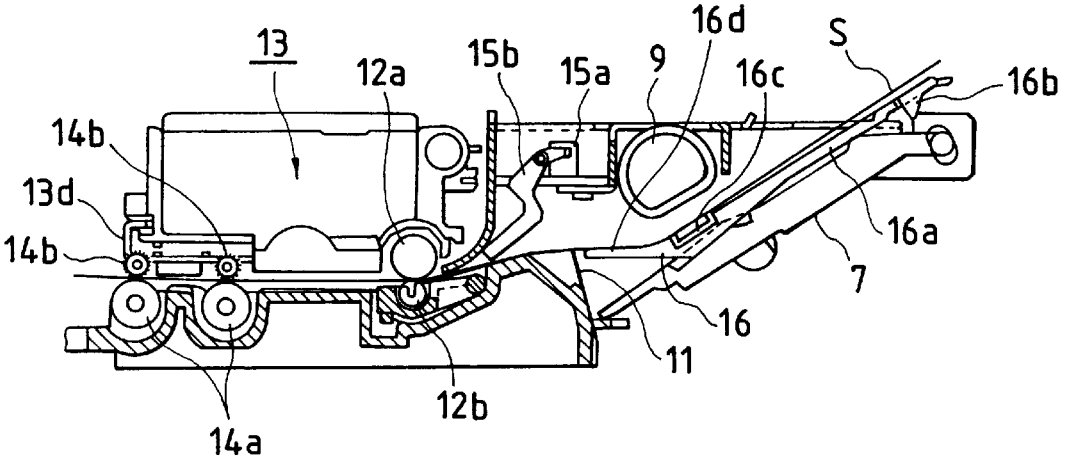
Figure 2:
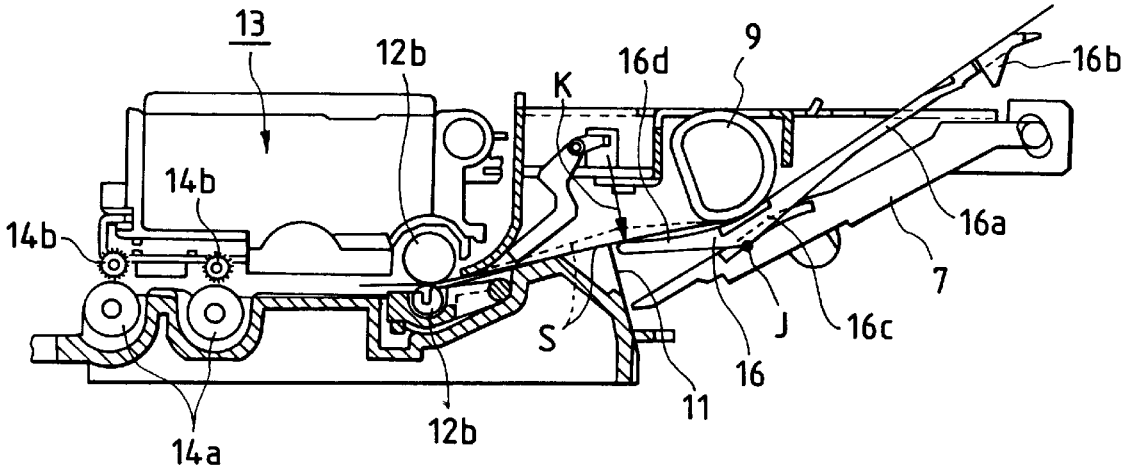
FIG. 2 is the view for explaining a condition in which the thick sheets are supplied.

Thus, as shown in FIG. 1B, the sheets S supplied by the pick-up roller 9 are almost not subjected the separation resistance from the abutment member 11, with the result that the sheets can ride over the abutment member with a very small force to reach the convey roller 12*a*. Accordingly, the very thin sheets S can be supplied without buckling. Incidentally, FIG. 1C shows a condition that, after the sheet supplying operation was finished, the pressure plate 7 is lowered by the cam (not shown) to separate the sheet stack S from the pick-up roller 9.

Although the sheet guide member 16 is particularly effective when the thin sheets are supplied as mentioned above, it is also effective when thick sheets are supplied. That is to say, when the thick sheets are conveyed, since the resiliency of the thick sheet is great, the greater the number of curved points in the sheet convey path, the greater the resistance force resisting to the conveyance of the sheets, thereby easily causing sheet jam or poor sheet conveyance.

However, when the sheet guide member 16 as mentioned above is attached, as shown in FIG. 2, although an imaginary convey path for the thin sheet S is shown by the broken line in FIG. 2, since the shick sheet S has great rigidity, the protruded portion 16*d* of the sheet guide member 16 is subjected to a force directing toward a direction K from the thick sheet. In this case, the sheet guide member 16 has the pivot point J positioned at a downstream side of a line starting from a rotational center of the pick-up roller 9 and extending normal to the pressure plate 7 (i.e., a contact point between the pick-up roller 9 and the pressure plate) and can be rocked around the pivot point J. Accordingly, the sheet guide member 16 is rocked around the pivot J in the counter-clockwise direction by the force K generated by the thick sheet S. As a result, the convey path for the thick sheet becomes as shown by the solid line. Consequently, the number of curved points in the sheet path is decreased to reduce the separation-resistance force resisting the conveyance of the sheet, thereby smoothly conveying the sheet without the sheet jam. Since a rocked angle of the sheet guide member is varied with the rigidity of the sheet, the sheet guide member is automatically adjusted to the optimum rocked angle.

In this way, by removing the sheet guide member 16 from the printer when the normal sheets are separated and supplied and by mounting the sheet guide member to the printer when the thin or thick sheets are separated and supplied, various kinds of sheets can surely be separated and supplied.

Figure 8:
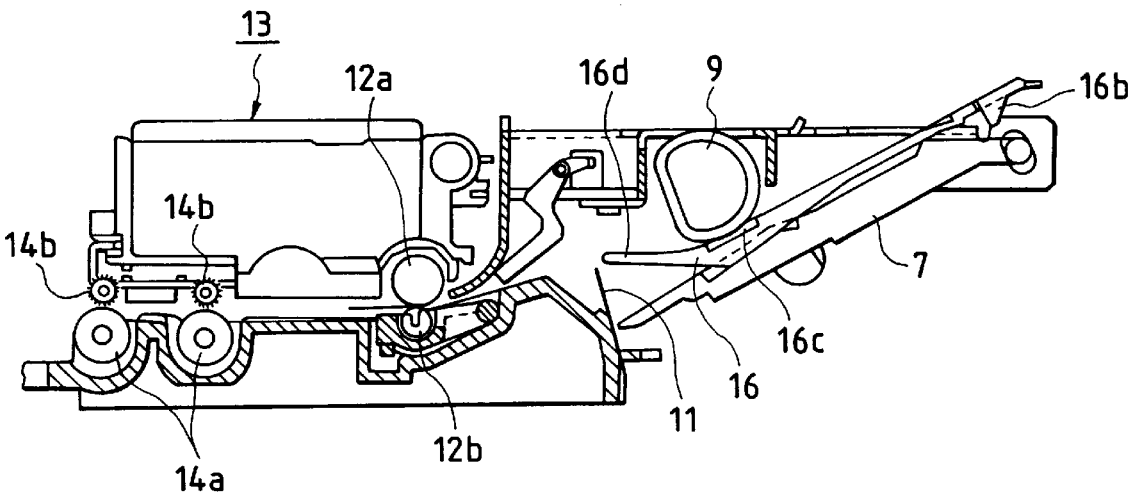
FIG. 8 is a sectional view showing an alteration in which a cleaning means is provided on a sheet guide member.

In an alteration, a sheet guide member 16 is provided with a cleaning means for cleaning the pick-up roller 9. This alteration will now be explained with reference to FIG. 8.

Since the pick-up roller 9 directly contacts with the sheet such as a paper sheet, as time goes on, paper powder and other foreign matter is transferred from the sheets to the pick-up roller 9. If foreign matters adheres to the surface of the pick-up roller 9, coefficient of friction between the pick-up roller and the sheet is decreased. To avoid a reduction of the coefficient of friction, there is provided a cleaning means 16*c* which can contact the pick-up roller 9. The cleaning means is formed from a material having a hardness and surface roughness greater than those of the pick-up roller 9. For example, the cleaning means may be formed from a sheet-shaped substrate to which abrasive particles are adhered (for example, sand-paper), or non-woven fabric (made of nylon or polyester) to which an abrasive agent is adhered, or a polyester sheet to which abrasive particles are adhered, or a porous material (for example, a porous plastic formed by sintering polyorefin particles having grain size of about 100 $\mu$m).

When the pick-up roller 9 is urged against the cleaning means 16*c* formed from the above-mentioned material on the sheet guide member 16 and the pick-up roller 9 is rotated, the surface of the roller 9 is polished by the cleaning means 16*c*, so that foreign matter adheres to the roller surface is removed. Thus, since the coefficient of friction between the pick-up roller 9 and the sheet S is not decreased, the sheet can always be supplied stably.

Incidentally, wet-cleaning using cleaning liquid is more effective than dry-cleaning using a dry cleaning means. Thus, the sheet guide member 16 may be mounted on the printer after the cleaning liquid was applied to the cleaning means 16*c*. In this case, hydrophilic non-woven fabric or plastic formed by sintering polyorefin particles may be used as the cleaning means 16*c*. Further, the cleaning liquid may be ethanol or water, which have high contamination removing ability and high friction-recovering ability.

Incidentallly, the cleaning means 16*c* may be secured to the sheet guide member 16, or the cleaning means 16*c* may be removably attached to the sheet guide member 16 to cause the sheet guide member to clean the pick-up roller 9.

Figure 9:
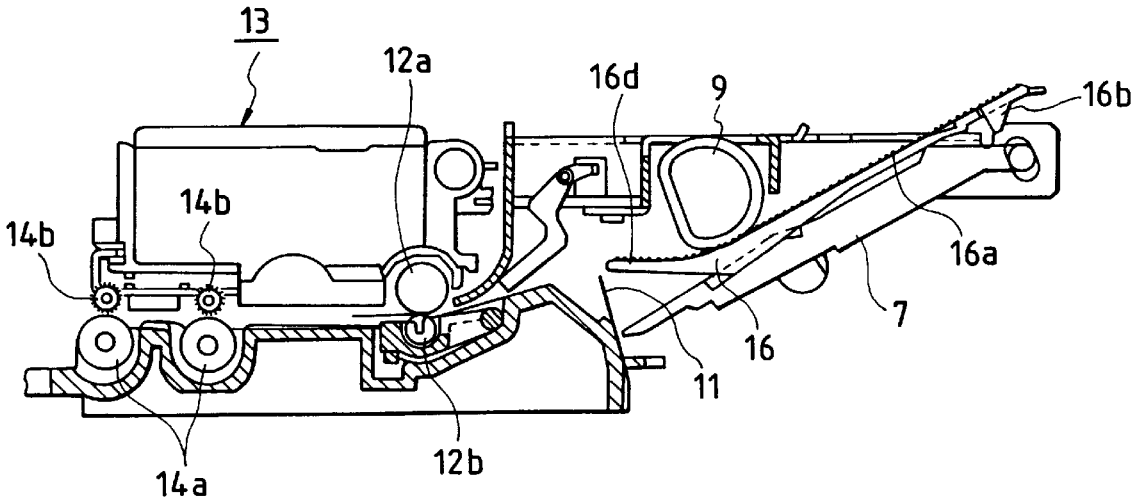
FIG. 9 is a sectional view showing an another alteration in which a cleaning means is provided on the entire guide surface of a sheet guide member.

Next, a further alteration, in which the entire surface of the guide portion 16*a* of the sheet guide member 16 has a function (cleaning means) for cleaning the pick-up roller 9, will be explained with reference to FIG. 9.

In this alteration, fine indentation is integrally formed on a surface of the guide portion 16*a* of the sheet guide member 16 opposed to the pick-up roller 9. Such a finely indented surface is generally called as "crimp surface", which can be formed by a blasting process (in which fine sand or fine glass particles are impinged against a surface of a plastic molding mold) or a chemical etching. When the guide portion 16*a* is formed from plastic by injection molding by using such a mold, the indentation is formed on the guide portion. By rotating the pick-up roller 9 while urging the pick-up roller against such a guide portion 16*a*, the paper powder or foreign matters can be removed from the pick-up roller 9 by the indentation.

With this arrangement, since the cleaning means can be formed simultaneously with the formation of the sheet guide member 16, the cleaning means can be manufactured in a cheaper and inexpensive manner.

Incidentally, when the sheet guide member 16 is formed from the above-mentioned porous material, the same advantage can be expected. In this case, the cleaning liquid may be applied to the sheet guide member.

In the above-mentioned embodiments, while an example that the ink-jet recording head is used as the recording means of the image forming apparatus was explained, other recording means, such as an electrophotographic-recording head, a heat-transfer recording head or other recording heads can be used. Further, in the above-mentioned embodiments, while an example that the sheet-supplying apparatus is used for supplying the recording sheet in the image-forming apparatus was explained, the sheet supplying apparatus may be used in an original-reading apparatus in which a plurality of originals are separated and supplied one by one, as well as the image forming apparatus. Further, in the above-mentioned embodiments, while an example that the pick-up roller 9 is used as the supply rotary member was explained, the supply rotary member is not limited to the roller, but may be a rotating belt.

What is claimed is:

1. A sheet supplying apparatus comprising:

sheet supporting means for supporting sheets;

supply rotary means for feeding out the sheets supported by said sheet supporting means;

a separation member for separating the sheets fed by said supply rotary means one by one; and a sheet guide member removably disposed above said sheet supporting means for guiding the sheet inserted thereon so as to be conveyed over said separation member, wherein said sheet guide member is provided with cleaning means for cleaning said supply rotary means.

2. A sheet supplying apparatus according to claim 1, wherein said separation member separates the sheets by elastically changing an inclination angle thereof when the sheets fed by said supply rotary means abut against and ride over said separation member.

3. A sheet supplying apparatus according to claim 1, wherein said sheet guide member has a protruded portion rockably mounted on said sheet supporting means and protruding toward a downstream direction to guide the sheet, and said sheet guide member is rocked by said protruded portion being pushed by rigidity of the sheet by an angle corresponding to the rigidity of the sheet.

4. A sheet supplying apparatus according to claim 3, wherein a rocking point of said sheet guide member is positioned downstream of a position where said sheet guide member is opposed to said supply rotary means, in a sheet guiding direction.

5. A sheet supplying apparatus according to claim 1, wherein a guide surface of said sheet guide member has a curved shape where a central portion is concaved upwardly.

6. A sheet supplying apparatus according to claim 1, wherein said sheet supporting means has a side guide for regulating edges of the sheets in a width direction, and said sheet guide member engages with said side guide to regulate a movement of said sheet guide member in a sheet guiding direction so as not to be fed out by a rotation of said supply rotary means when said supply rotary means is rotated to be cleaned by said cleaning means provided on said sheet guide member.

7. A sheet supplying apparatus according to claim 1, wherein said sheet guide member is provided with a cleaning means for cleaning said supply rotary means.

8. A sheet supplying apparatus according to claim 7, wherein said cleaning means is made of a porous member.

9. A sheet supplying apparatus according to claim 8, wherein said porous member is hydrophilic.

10. A sheet supplying apparatus according to claim 7, wherein said cleaning means is made of a sintered member of polyorefin resin.

11. A sheet supplying apparatus according to claim 1, wherein said sheet guide member guides the sheet in such a manner that said sheet guide member provides less resistance than if said sheet supplying apparatus is operated without said sheet guide member.

12. An image forming apparatus comprising:

sheet supporting means for supporting sheets;

supply rotary means for feeding out the sheets supported by said sheet supporting means;

a separation member for separating the sheets fed by said supply rotary means one by one;

a sheet guide member removably disposed above said sheet supporting means for guiding the sheet inserted thereon so as to be conveyed over said separation member, wherein said sheet guide member is provided with a cleaning means for cleaning said supply rotary means; and image forming means for forming an image on the sheet fed from said sheet supporting means or said sheet guide member.

* * * * *

UNITED STATES PATENT AND TRADEMARK OFFICE

CERTIFICATE OF CORRECTION

PATENT NO. : 6,131,899

DATED : October 17, 2000

INVENTOR(S): TAKASHI NOJIMA, ET AL.

It is certified that error appears in the above-identified patent and that said Letters Patent is hereby corrected as shown below:

COVER PAGE AT ITEM [56] RC:
Foreign Patent Documents: "8-040590 2/1996 Japan" should be deleted.

COVER PAGE AT ITEM [57] ABSTRACT:
Line 9, "supporting means' should read --supporter--.

COLUMN 1:
Line 39, "Myler" should read --Mylar--.

COLUMN 3:
Line 37, "abut" should be --abuts--.

COLUMN 6:
Line 22, "polyorefin" should read --polyolefin--.

UNITED STATES PATENT AND TRADEMARK OFFICE

CERTIFICATE OF CORRECTION

PATENT NO. : 6,131,899

DATED : October 17, 2000

INVENTOR(S): TAKASHI NOJIMA, ET AL.

It is certified that error appears in the above-identified patent and that said Letters Patent is hereby corrected as shown below:

COLUMN 8:
Line 24, "polyorefin" should read --polyolefin--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*